US008885346B2

(12) United States Patent
Li et al.

(10) Patent No.: US 8,885,346 B2
(45) Date of Patent: Nov. 11, 2014

(54) ELECTRONIC DEVIEC HAVING HEAT DISSIPATION DEVICE

(75) Inventors: Shih-Yao Li, New Taipei (TW); Jui-Wen Hung, New Taipei (TW); Ching-Bai Hwang, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 186 days.

(21) Appl. No.: 13/418,366

(22) Filed: Mar. 13, 2012

(65) Prior Publication Data

US 2013/0201630 A1 Aug. 8, 2013

(30) Foreign Application Priority Data

Feb. 8, 2012 (TW) ..... 101104023

(51) Int. Cl.
*H05K 7/20* (2006.01)

(52) U.S. Cl.
USPC ..... 361/720; 361/704; 165/80.2; 165/80.3; 174/16.3

(58) Field of Classification Search
None
See application file for complete search history.

(56) References Cited

U.S. PATENT DOCUMENTS

| | | | | |
|---|---|---|---|---|
| 5,168,348 | A * | 12/1992 | Chu et al. | 257/713 |
| 5,852,548 | A * | 12/1998 | Koon et al. | 361/704 |
| 6,367,541 | B2 * | 4/2002 | McCullough | 165/80.3 |
| 6,436,506 | B1 * | 8/2002 | Pinter et al. | 428/86 |
| 6,556,444 | B2 * | 4/2003 | Smith et al. | 361/704 |
| 6,713,151 | B1 * | 3/2004 | Dean et al. | 428/86 |
| 6,749,010 | B2 * | 6/2004 | Getz et al. | 165/80.3 |
| 6,844,054 | B2 * | 1/2005 | Whatley | 428/295.4 |
| 7,399,919 | B2 * | 7/2008 | McCutcheon et al. | 174/16.3 |
| 7,969,740 | B2 * | 6/2011 | Miyahara | 361/704 |
| 8,023,267 | B2 * | 9/2011 | Streyle et al. | 361/707 |
| 8,194,407 | B2 * | 6/2012 | Yamaguchi et al. | 361/708 |
| 2005/0168941 | A1 * | 8/2005 | Sokol et al. | 361/688 |
| 2010/0172101 | A1 * | 7/2010 | Yao et al. | 361/704 |

* cited by examiner

*Primary Examiner* — Boris Chervinsky
(74) *Attorney, Agent, or Firm* — Novak Druce Connolly Bove + Quigg LLP

(57) ABSTRACT

An exemplary electronic device includes a printed circuit board, electronic components mounted on a top surface of the printed circuit board, and a heat dissipation device. The heat dissipation device contacts the electronic components to absorb heat generated from the electronic components and dissipate the heat by natural convection and thermal radiation. The heat dissipation device includes a base plate contacting the electronic components to absorb heat generated therefrom and thermal hairs mounted on a top surface of the base plate. The thermal hairs wave with heated airflow at an inner of the electronic device to dissipate heat transferred from the base plate.

10 Claims, 3 Drawing Sheets

ELECTRONIC DEVIEC HAVING HEAT DISSIPATION DEVICE

BACKGROUND

1. Technical Field

The present disclosure relates to heat dissipation devices, and more particularly to a heat dissipation device dissipating heat generated by electronic components of an electronic device.

2. Description of Related Art

As electronic products continue to develop, heat generated from electronic components of the electronic products become more and more. Conventionally, a heat absorbing member such as a graphite sheet or a metal sheet is used to contact the electronic components of the electronic product to absorb heat generated from the electronic components. However, the heat of the heat absorbing member is dissipated slowly via natural convection and thermal radiation in a narrow space of an inner side of the electronic product. Therefore, the electronic components thereof are prone to be overheated.

Accordingly, it is desirable to provide an electronic device having a heat dissipation device which can overcome the above described disadvantages.

DETAILED DESCRIPTION

Figure 1:
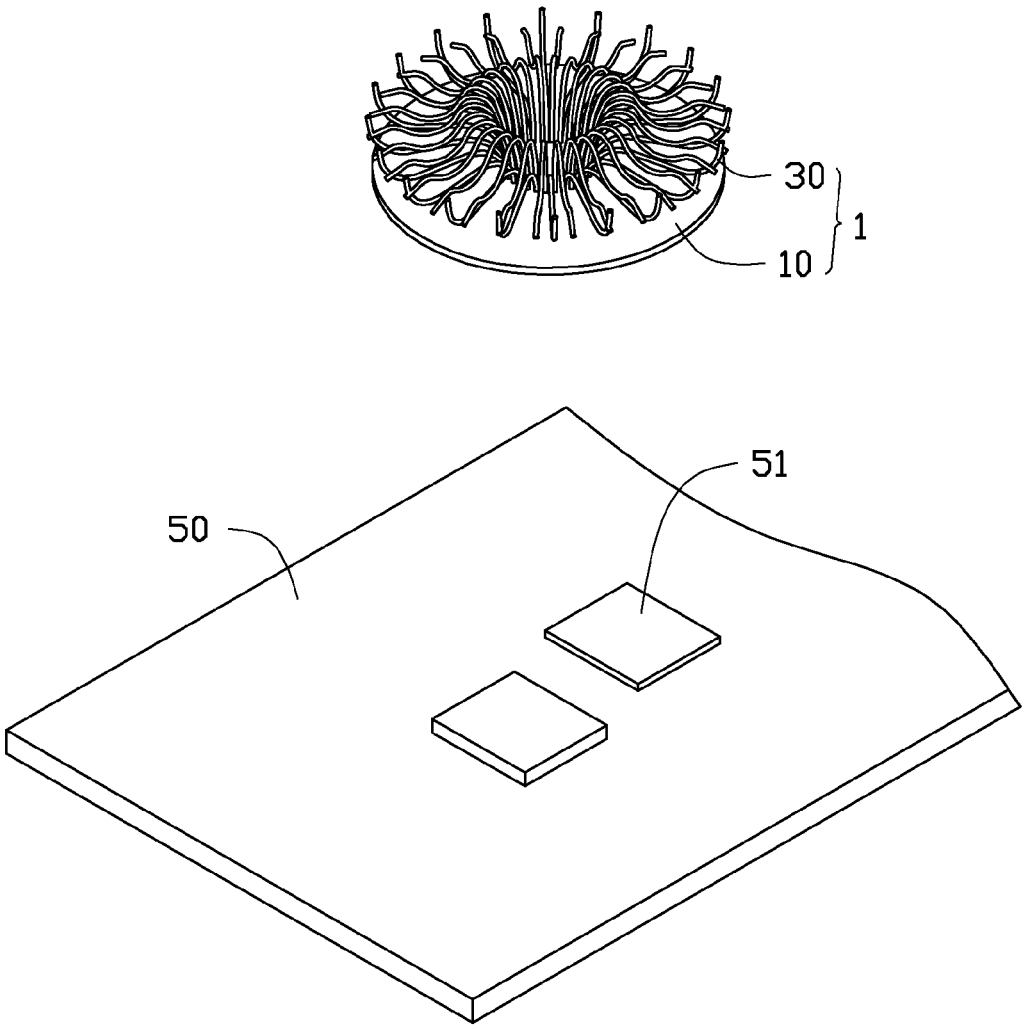
FIG. 1 is an exploded view of an electronic device of a first embodiment of the present disclosure.
Figure 2:
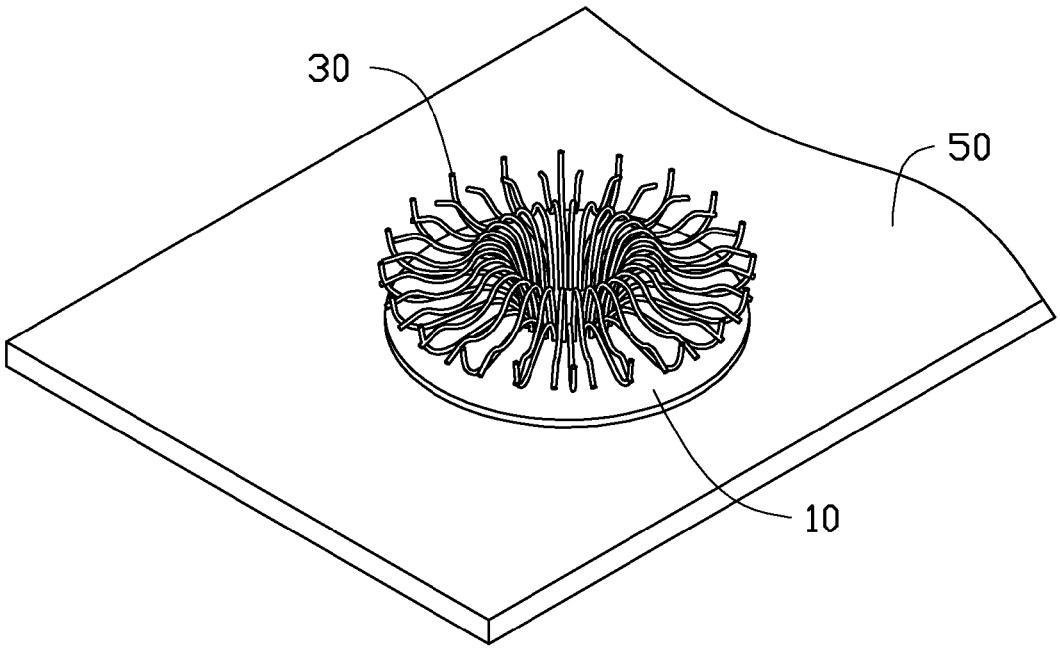
FIG. 2 is an assembled view of the electronic device of FIG. 1.

Referring to FIGS. 1-2, an electronic device of the first embodiment includes a printed circuit board (PCB) 50, two spaced electronic components 51 mounted on a top surface of the PCB 50 and a heat dissipation device 1 directly contacting the electronic components 51 to dissipate heat generated from the electronic components 51. In this embodiment, each electronic component 51 has a height different from each other. More specifically, a top surface of one electronic component 51 is located above of a top surface of the other electronic component 51.

The heat dissipation device 1 includes a base plate 10 and a plurality of thermal hairs 30 mounted on a central portion of a top surface of the base plate 10. The base plate 10 is a disk-like sheet and has good heat absorbing capability. In this embodiment, the base plate 10 is flexible and directly contacts the electronic components 51 simultaneously.

The thermal hairs 30 are formed on the base plate 10 by chemical vapor deposition, soldered, or adhered. Each thermal hair 30 is a flexible strip and made of a material having good heat dissipation effectiveness. A bottom end of each thermal hair 30 is formed on the top surface of the base plate 10. The bottom ends of the thermal hairs 30 are spaced from each other. A diameter of each thermal hair 30 is less than 0.2 millimeter. The thermal hair 30 is very light.

When the electronic device is worked, heat generated from the electronic components 51 is absorbed by the base plate 10. A part of the heat of the base plate 10 is transferred to the thermal hairs 30 then radiates by the thermal hairs 30, the other part of the heat directly radiates to an inner of the electronic device. The radiated heat heats air at the inner of the electronic device to produce airflow, and heated airflow goes upward. The thermal hairs 30 wave with the heated airflow to increase heat radiation efficiency of the heat dissipation device 1.

Figure 3:
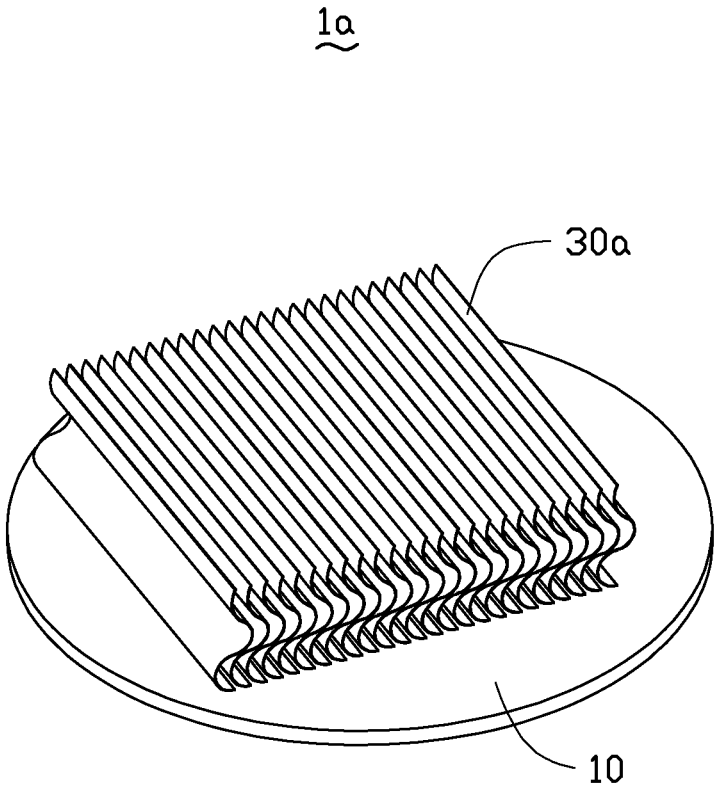
FIG. 3 is a heat dissipation device of a second embodiment of the present disclosure.

Referring to FIG. 3, a heat dissipation device 1*a* of a second embodiment is shown. The heat dissipation device 1*a* and the heat dissipation device 1 are similar and a different therebetween is that the heat dissipation device la includes a plurality of flexible, rectangular thermal hairs 30*a*. A bottom side of each thermal hair 30*a* is formed on the base plate 10. The thermal hairs 30*a* are spaced from each other. A thickness of each thermal hair 30*a* is less than 0.2 millimeter.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An electronic device comprising:

a printed circuit board;

a plurality of electronic components mounted on a top surface of the printed circuit board; and a heat dissipation device contacting the electronic components to absorb heat generated from the electronic components and dissipate the heat by natural convection and thermal radiation, the heat dissipation device comprising:

a base plate contacting the electronic components to absorb heat generated therefrom; and a plurality of thermal hairs mounted on a top surface of the base plate;

wherein each thermal hair is macroscopical, a diameter of each thermal hair is less than 0.2 millimeter to make the thermal hairs wave with heated airflow at an inner of the electronic device to radiate heat transferred from the base plate.

2. The electronic device of claim 1, wherein each electronic components has a height different from each other, and the base plate is flexible and directly contacts the electronic components simultaneously.

3. The electronic device of claim 1, wherein each thermal hair is a flexible strip and a bottom end thereof is mounted on the base plate.

4. The electronic device of claim 3, wherein the bottom ends of the thermal hairs are spaced from each other.

5. The electronic device of claim 1, wherein the thermal hairs are formed on the base plate by chemical vapor deposition, soldered, or adhered.

6. A heat dissipation device comprising:

a base plate for contacting a heat generating source; and a plurality of thermal hairs mounted on a top surface of the base plate;

wherein each thermal hair is macroscopical, a diameter of each thermal hair is less than 0.2 millimeter to make the thermal hairs wave with heated airflow heated by the heat generating source to dissipate heat transferred from the base plate.

7. The heat dissipation device of claim 6, wherein the base plate is flexible.

8. The heat dissipation device of claim 6, wherein each thermal hair is a flexible strip and a bottom end thereof is mounted on the base plate.

9. The heat dissipation device of claim 8, wherein the bottom ends of the thermal hairs are spaced from each other.

10. The heat dissipation device of claim 6, wherein the thermal hairs are formed on the base plate by chemical vapor deposition, soldered, or adhered.

* * * * *